United States Patent [19]

Taki

[11] 4,209,044

[45] Jun. 24, 1980

[54] SLING BELT

[75] Inventor: Kiyoji Taki, Gamagoori, Japan

[73] Assignee: Kabushiki Kaisha Miura Kumihimo Kojyo, Aichi, Japan

[21] Appl. No.: 927,987

[22] Filed: Jul. 26, 1978

[51] Int. Cl.[2] ..... D03D 11/00

[52] U.S. Cl. ..... 139/411; 139/420 R; 294/74; 428/245; 428/252; 428/257

[58] Field of Search ..... 428/245, 246, 252, 255, 428/257, 258, 259; 139/411, 409, 408, 410, 412, 413, 415, 420 R; 294/74

[56] References Cited

U.S. PATENT DOCUMENTS

| | | | |
|---|---|---|---|
| 3,776,585 | 12/1973 | Bridgehouse | 139/411 |
| 3,957,090 | 5/1976 | Mühlon | 139/409 |
| 4,025,100 | 5/1977 | Bridgehouse | 139/411 |

FOREIGN PATENT DOCUMENTS

| | | | |
|---|---|---|---|
| 698008 | 1/1931 | France | 139/409 |
| 53-14777 | 4/1978 | Japan . | |
| 53-29811 | 7/1978 | Japan . | |
| 262214 | 12/1926 | United Kingdom | 139/409 |
| 333162 | 8/1930 | United Kingdom | 139/409 |

*Primary Examiner*—James J. Bell

*Attorney, Agent, or Firm*—Stevens, Davis, Miller & Mosher

[57] ABSTRACT

Herein disclosed is a belt which is suitable especially for a sling to lift or hoist an article. The sling belt chiefly comprises a sheath of filament yarns made of polyamide synthetic fibers, and a core of filament yarns made of polyester synthetic fibers. The sheath covering the core has two sides, i.e., an upper or face side, which is to be brought into direct contact with the article, and a lower or back side which is apart from the article. The face side is made thicker than the back side to improve the anti-abrasiveness thereby to extend the life of the sling belt as a whole.

10 Claims, 4 Drawing Figures

SLING BELT

BACKGROUND OF THE INVENTION

1. Field of the Invention

The present invention relates to a sling to be fastened around an object which is to be raised or moved by a crane or hoist, and more particularly to a belt which can be used to produce such sling.

2. Description of the Prior Art

Generally speaking, wire ropes are widely used as a sling so as to raise and move an article. However, the wire ropes lack flexibility and weigh so much as to make their fastening operations around the article difficult. In order to eliminate such difficulty, a rope or belt made of fibers has recently been used as a sling. The requirements for the fibrous sling rope or belt of that kind are that it has a low elongation, close to that of the wire rope and that it has excellent anti-abrasiveness properties and strength. If a sling has a relatively large elongation, it may fail to securely hold an article during the lifting operation so that the article will fall from the sling. This may result in a dangerous accident, which has to be obviated from safety consideration. From this consideration, therefore, polyester synthetic fibers, which are known to have a relatively small elongation, can be said suitable as the material for a fibrous sling belt. The polyester synthetic fibers are, however, inferior in anti-abrasiveness to polyamide synthetic fibers. With this fact in mind, there has been developed a sling belt of wadded double fabric which can suitably satisfy the above conditions by using as the core material the filament yarns of polyester synthetic fibers having a smaller elongation and as the sheath material filament yarns of polyamide synthetic fibers having excellent anti-abrasiveness.

The invention, which was filed for Japanese Utility Model Registration on Dec. 18, 1973 by the Applicant of the present Patent Application and which can be located in Japanese Utility Model Publication No. 53-14777 published on Apr. 19, 1978, is also directed to a sling belt having the structure thus far described. The sling belt disclosed is composed of: a sheath which is prepared by plainly weaving the warp yarns and the weft yarn of polyamide synthetic fibers such as nylon; a core which is arranged in the sheath and which is prepared by plainly weaving this warp yarns of polyester synthetic fibers such as Tetrone (Registered Trade Name) with the weft yarn leading to and from that of the sheath such that the interlacing points of the core are made fewer than those of the sheath; and binder warp yarns which are woven at a suitable spacing to intersect alternately thereby to bind together the both sides of the sheath. Thus, the sling belt has the weave of wadded double fabric, in which the sheath and core are dyed in different colors. This belt is remarkably excellent in endurability and safety in comparison with the belt of the prior art.

As is well known in the relevant art, in the case of normal use of a belt sling, it is only one side of the sheath that is brought into direct contact with an object to be lifted. This face side, to contact with the object, is subject to more abrasion than the back side. Since the sling belt uses the abrasion of its sheath as a measure of its disposal, its life would be uselessly shortened if the face side of higher abrasiveness were made to have the same thickness as that of the back side of lower abrasiveness. The aforementioned sling belt disclosed in the Japanese Utility Model Publication has the face and back sides of the same thickness and the resultant drawback.

SUMMARY OF THE INVENTION

It is, therefore, a major object of the present invention to provide a belt which has satisfactory flexibility by making such a non-contact side relatively thinner as is subject to less abrasion and which can extend the life of the sling by making such a contact side relatively thicker as it is subject to more abrasion. In order to achieve this object, the sling belt according to the present invention has the thickness of the contact face side substantially twice as that of the non-contact back side. The thinner back side is made thinner than either of the two sides of the belt of the Japanese Utility Model Publication but the thicker face side is made thicker than the same, while maintaining the overall thicknesses of those two structures substantially identical.

Another object of the present invention is to provide a sling belt of the above type, in which the face and back sides constituting the sheath can be discriminated without any difficulty. In order to achieve this second object, one or more reference warp yarns having a different color from the yarns of the sheath are woven into either the face or back side of the sheath.

BRIEF DESCRIPTION OF THE DRAWINGS

Other objects and advantages of the present invention will be better understood from the following detailed description made in connection with one embodiment thereof with reference to the accompanying drawing, in which.

DESCRIPTION OF THE PREFERRED EMBODIMENT

Figure 1:
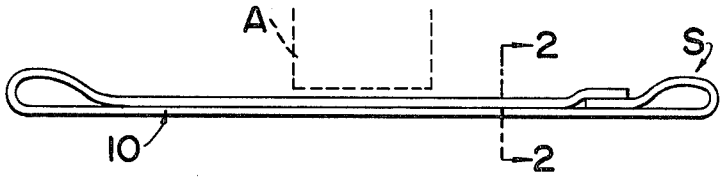
FIG. 1 is an overall side elevation showing a sling which is produced with the use of a belt according to the present invention.

Referring first to FIG. 1, reference numeral S indicates a sling which is formed of a belt 10 according to the present invention so as to lift an article A shown partially in broken lines. The use of the sling S is well known in the relevant art, and as such the detailed description thereof is omitted here. The sling belt 10 is made of wadded hollow cloths or wadded double fabric, as better seen from FIG. 2, which is composed of a tubular sheath 12 and a core 14 arranged to extend longitudinally in the hollow portion of the sheath 12. This sheath 12 is divided into an upper or face side **12*a*, which is brought into direct contact with the article or object A during the lifting operation, and a lower or back side 12*b* which is positioned apart from the article A during that operation. There extends at the widthwise center of the back side 12*b* two reference warp yarns 16**, the detailed discussion of which will be made later.

The weave of the sling belt 10 will be described in more detail with reference to FIGS. 3 and 4. The sling belt 10 is further composed of binder warp yarns 18, 18' and 18" which are used to intersect alternately so as to bind together the face and back sides 12*a* and 12*b* of the sheath 12. The face side 12*a* is composed of warp yarns 20 and 20', which are made of polyamide synthetic fibers such as nylon filaments, and a weft yarn 22 which interlaces with the warp yarns 20 and 20' by a plain weave. This weft yarn 22 may also preferably be made of nylon filaments. On the other hand, the back side 12*b* is composed of warp yarns 24 and a weft yarn 26, both of which are also made of nylon filaments. It should be noted here that the warp yarns of those two sides 12*a* and 12*b* are not made to intersect the weft yarn of the other side so that a run due to breakage of the warp yarns can be minimized. It should also be noted that the weave of the sheath 12 be not limited to the plain type but can be of either twill or satin type.

According to a major feature of the present invention, the face side 12*a* of the sheath 12 is made thicker than the back side 12*b*. For instance, in case the belt 10 has a width of about 50 mm, the overall thickness is usually preset at about 4 mm. In this case, the belt 10 has a core thickness of about 1.6 mm, a face side thickness of about 1.5 mm and a back side thickness of about 0.9 mm, while the belt disclosed in Japanese Utility Model Publication No. 53-14777 has a core thickness of about 1.6 mm and face and back side thicknesses of about 1.2 mm. According to the present invention, the life of the belt 10 can be remarkably extended by making the thickness of the face side 12*a* about two times that of the back side 12*b* while keeping the overall thickness of the belt unchanged. This has been revealed by the experiments of the Inventor, which were conducted for the abrasion tests of the belts of those two types in accordance with the JIS (Japanese Industrial Standards) standards concerning car belts. The conventional belt having face and back sides of the same thickness was worn out at their surface a disposable condition after abrasion tests of 3000 to 5000 times. On the contrary, the belt of the present invention could stand the abration tests of 10000 times and was not brought into a disposable condition until the abrasion tests were conducted 12000 to 15000 times. As is apparent from the above experiments, the belt of the invention can enjoy endurance of about three to four times in comparison with the conventional belt although the absolute strength of the two belts is substantially the same. It is also apparent that the thickness of the face side 12*a* can be freely changed by merely changing the thickness and number of the warp yarns themselves in accordance with the desired strength and width of the belt.

Another major component of the belt 10 is that the core 14 is covered with the sheath 12, in other words, arranged to extend longitudinally in the hollow portion of the sheath 12. The core 14 thus constructed is composed of warp yarns 28, which are made of polyester synthetic fibers or Tetrone (Registered Trade Name) filaments, and a weft yarn 30 which leads to and from the weft yarns 22 and 26 of the face and back sides 12*a* and 12*b* and which interlaces with the warp yarns 28 so as to produce a plain weave. It should be noted here that the interlacing points of the warp yarns 28 are made fewer than those of the warp yarns 20, 20' and 24 of the sheath 12.

The binder warp yarns 18, 18' and 18" binding the face and back sides 12*a* and 12*b* are made to intersect alternately every weft yarns 22 and 26 of both sides 12*a* and 12*b*. As shown in FIGS. 3 and 4, the binder warp yarns 18, 18' and 18" are woven in the longitudinal direction of the belt 10 uniformly in the widthwise direction, e.g., at the ratio of every fourth warp yarns 20, 20' and 24. In order to reduce the surface roughnesses of the sheath 12 as much as possible to obtain flat surfaces, the weft yarns 22 and 26 which are intersected by the respective binder warp yarns 18, 18' and 18" are consecutively shifted one by one. This weave is also an important feature of the present invention, by which the surface roughnesses of the belt 10 can be minimized to further improve the anti-abrasiveness of the belt. The binder warp yarns 18, 18' and 18" may preferably be made of synthetic fibers which have the same elongation as that of the yarns of the sheath 12 but have a smaller denier.

Figure 2:
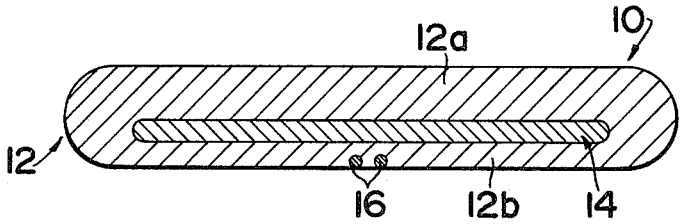
FIG. 2 is an enlarged cross-section taken along the line 2—2 of FIG. 1.

Referring now to FIG. 2, the reference warp yarns 16 are provided to facilitate discrimination between the upper or face side 12*a* and the lower or back side 12*b* of the sheath 12. For this purpose, one or more reference warp yarns 16 are woven into either the face or back side 12*a* or 12*b*. Since, in the belt 10 of the present invention, the core 14 is dyed white while the sheath 12 is dyed blue, the reference warp yarns 16 are dyed yellow so as to ensure the discrimination.

As has been described hereinbefore, according to the present invention, one of the sides of the sheath covering the core, i.e., the face side to be brought into direct contact with the object to be lifted is made thicker than the back side. Thus, it should be appreciated as a major advantage of the present invention that the life of the whole belt can be remarkably extended without substantially sacrificing the flexibility of the belt. Since the reference warp yarn or yarns are woven into either the face or back side of the sheath, it should also be appreciated that the both sides can be descriminated with ease thereby to eliminate any accident which might otherwise take place as a result of mistaken recognition of the sides. Since, moreover, the binder warp yarns binding the two sides of the sheath are made to intersect the weft yarns of the two side consecutively with a shift, it should also be appreciated that the sheath surfaces can be made relatively uniform thereby to further improve the anti-abrasiveness of the sheath.

The sling belt according to the present invention will be further discussed in the following Example.

EXAMPLE

Figure 3:
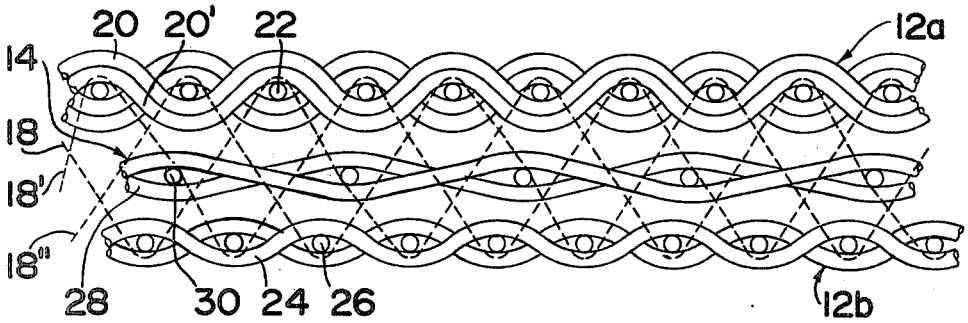
FIG. 3 is a diagramatic sectional view showing the weave of the longitudinal section of the belt according to the present invention.
Figure 4:
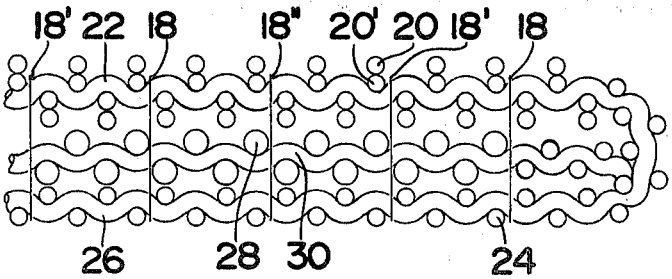
FIG. 4 is also a diagramatic sectional view that shows the weave of the cross-section of the belt of the present invention.

A sample of the belt was woven using the weave shown in FIGS. 2 to 4 and the following yarns:

- Warp Yarns for Sheath: 840 D/3 Doubling/252 (Nylon of Toray Industries, Inc.)
- Warp Yarns for Core: 1500 D/3 Doubling/132 (Tetrone of Toray Industries, Inc.)
- Salvage Yarns for Core: 840 D/3 Doubling/32 (Leona of Asahi Chemical Industry Co., Ltd.)
- Weft Yarn for Sheath and Core: 840 D/3 Doubling (Nylon of Toray Industries, Inc.)
- Binder Warp Yarns: 840 D/2 Doubling/20 (Nylon of Toray Industries, Inc.)
- Reference Yarns: 680 D/2 Doubling/2 (Pyren of Mitsubishi Rayon Company Limited)

The number of weft yarns was: 10/inch for one side of Sheath; and 5/inch for Core.

The belt thus woven had a width of 50 mm and an overall thickness of 4 mm (including 1.6 mm for Core, 1.5 mm for Face Side and 0.9 mm for Back side).

The belt was then subjected consecutively to dying, rinsing and drying processes and further to cutting and stiching operations so that the sling shown in FIG. 1 could be produced. The final product had such colors that the sheath and its selvages are dyed blue while the core was white and the reference yarns were yellow.

What is claimed is:

1. In a sling belt made of wadded double fabric for lifting an object, having: a sheath including warp yarns and a weft yarn made of polyamide synthetic fibers, said sheath having a face side, which is adapted to be brought into direct contact with the object during the lifting operation, and a back side which is positioned apart from the object during the same operation; a core including warp yarns made of polyester synthetic fibers and a weft yarn leading to and from the weft yarn of said sheath, and arranged to extend longitudinally in the hollow portion of said sheath; and binder warp yarns interlacing alternately to the weft yarns of the face and back sides of said sheath, wherein the improvement comprises the face side of said sheath being thicker than the back side of the same.

2. A sling belt according to claim 1 wherein the thickness of the face side is made substantially twice the thickness of the back side.

3. A sling belt according to claim 1, further comprising a reference warp yarn arranged in one of the face and back sides of said sheath for identification thereof.

4. A sling belt according to claim 3, wherein said reference warp yarn has a different color from the yarns of said sheath and runs longitudinally along the widthwise center of the side in which it is placed.

5. A sling belt according to claim 1, wherein the warp yarns of said sheath are nylon filaments, and wherein the warp yarns of said core are polyester synthetic fiber filaments.

6. A sling belt according to claim 1, wherein the weft yarns of the both sides of said sheath, which are intersected by said binder warp yarns, are consecutively shifted one by one to reduce the surface roughnesses of said both sides.

7. A sling belt according to claim 1, wherein said binder warp yarns are made of synthetic fibers which have substantially the same elongation as the elongation of the yarns of said sheath but are of a smaller denier.

8. A sling belt according to claim 1, wherein there are fewer interlacing points of the warp yarns of said core than interlacing points of the warp yarns of said sheath.

9. A sling belt made of wadded double fabric for lifting an object, comprising:

a sheath including warp and weft yarns made of polyamide synthetic fibers, said sheath having a face side to contact the object during lifting and a back side which is positioned apart from said object during lifting;

the warp yarns of the face side being thicker than the warp yarns of the back side;

the weft yarns of the back side being longitudinally offset in relation to the weft yarns of the face side so as to lie approximately half way between so that the belt thickness is minimized;

a core positioned between said face and back sides and having warp yarns of polyester synthetic fibers and weft yarns;

the weft yarns of said core being longitudinally offset from the weft yarns of both the face and back side weft yarns;

a plurality of binder warps each extending directly from the face side of the sheath to the back side thereof by passing around a weft component of the face side to a weft component of the back side; without passing around a weft component of said core; the face and back side wefts encompassed by a particular binder warp being longitudinally offset from each other by at least one weft spacing.

10. The sling belt of claim 9 in which the thickness of said face side is substantially twice the thickness of said back side.

* * * * *